US012442137B2

(12) United States Patent
Zitturi et al.

(10) Patent No.: US 12,442,137 B2
(45) Date of Patent: Oct. 14, 2025

(54) HEAT-RESISTANT WRAPPER PAPER FOR AEROSOL-GENERATING ARTICLES

(71) Applicant: DELFORTGROUP AG, Traun (AT)

(72) Inventors: Roland Zitturi, Innsbruck (AT); Dietmar Volgger, Gnadenwald (AT)

(73) Assignee: DELFORTGROUP AG, Traun (AT)

( * ) Notice: Subject to any disclaimer, the term of this patent is extended or adjusted under 35 U.S.C. 154(b) by 187 days.

(21) Appl. No.: 18/012,571

(22) PCT Filed: May 18, 2021

(86) PCT No.: PCT/EP2021/063133

§ 371 (c)(1),
(2) Date: Dec. 22, 2022

(87) PCT Pub. No.: WO2022/002477

PCT Pub. Date: Jan. 6, 2022

(65) Prior Publication Data

US 2023/0250590 A1 Aug. 10, 2023

(30) Foreign Application Priority Data

Jul. 1, 2020 (DE) ..... 10 2020 117 368.7

(51) Int. Cl.

| | |
|---|---|
| ***D21H 21/34*** | (2006.01) |
| ***A24D 1/02*** | (2006.01) |
| ***A24D 1/20*** | (2020.01) |
| ***D21H 17/00*** | (2006.01) |
| ***D21H 17/28*** | (2006.01) |
| ***D21H 17/66*** | (2006.01) |
| ***D21H 17/67*** | (2006.01) |
| ***D21H 19/10*** | (2006.01) |

(52) U.S. Cl.

CPC ..... *D21H 21/34* (2013.01); *A24D 1/02* (2013.01); *A24D 1/20* (2020.01); *D21H 17/28* (2013.01); *D21H 17/66* (2013.01); *D21H 17/675* (2013.01); *D21H 17/74* (2013.01); *D21H 19/10* (2013.01)

(58) Field of Classification Search

CPC ..... D21H 21/34; D21H 17/28; D21H 17/66; D21H 17/675; D21H 17/74; D21H 19/10; D21H 17/10; D21H 27/00; A24D 1/02; A24D 1/20

See application file for complete search history.

(56) References Cited

U.S. PATENT DOCUMENTS

| | | | |
|---|---|---|---|
| 2,754,207 | A | 7/1956 | Schur et al. |
| 4,998,543 | A | 3/1991 | Goodman et al. |
| 5,038,804 | A | 8/1991 | Chao et al. |
| 5,109,876 | A | 5/1992 | Hayden et al. |
| 6,837,248 | B2 | 1/2005 | Zawadzki et al. |
| 2004/0094173 | A1 | 5/2004 | Ishikawa et al. |
| 2008/0011312 | A1 | 1/2008 | Matsufuji et al. |
| 2016/0120214 | A1 | 5/2016 | Volgger et al. |
| 2018/0092397 | A1 | 4/2018 | Pesendorfer et al. |
| 2022/0256913 | A1 | 8/2022 | Zitturi |

FOREIGN PATENT DOCUMENTS

| | | | | | |
|---|---|---|---|---|---|
| CN | 108589420 | A | * | 9/2018 | ..... D21H 21/14 |
| DE | 102013106516 | B3 | | 10/2014 | |
| DE | 102015105882 | A1 | | 10/2016 | |
| DE | 102019112777 | B3 | | 8/2020 | |
| EP | 1084629 | A1 | | 3/2001 | |
| KR | 20040027557 | A | | 4/2004 | |
| WO | 2001008514 | A1 | | 2/2001 | |
| WO | 2011139730 | A1 | | 11/2011 | |
| WO | 2018098276 | A1 | | 5/2018 | |

OTHER PUBLICATIONS

International Searching Authority/EP, International Search Report and Written Opinion of the International Searching Authority, Application No. PCT/EP2021/063133, dated Jul. 26, 2021, 10 pages.

* cited by examiner

*Primary Examiner* — Abbas Rashid
*Assistant Examiner* — Matthew M Eslami
(74) *Attorney, Agent, or Firm* — Barclay Damon LLP

(57) ABSTRACT

The invention concerns a wrapper paper which is suitable for use on aerosol-generating articles and which comprises pulp fibers and a char-former, wherein the pulp fibers make up at least 70% and at most 95% of the mass of the wrapper paper and the char-former is contained in a concentration of at least 5% and at most 20% with respect to the mass of the wrapper paper and is present in a concentration in the wrapper paper such that the quotient $r=R_T/R_o$ of the tensile strength $R_o$, measured in accordance with ISO 1924-2:2008 under the conditions of ISO 187:1990, and of the tensile strength $R_T$, measured in accordance with ISO 1924-2:2008 under the conditions of ISO 187:1990 after the wrapper paper has been exposed to a temperature of 230° C. for one minute, is at least 0.20 and at most 0.90.

22 Claims, No Drawings

HEAT-RESISTANT WRAPPER PAPER FOR AEROSOL-GENERATING ARTICLES

CROSS-REFERENCE TO RELATED APPLICATIONS

This application is the national phase entry of International Patent Application No. PCT/EP2021/063133, filed May 18, 2021, and claims the benefit of German Patent Application No. 10 2020 117 368.7, filed Jul. 1, 2020, the disclosures of which are incorporated herein by reference in their entirety.

FIELD OF THE INVENTION

The invention relates to a wrapper paper for an aerosol-generating article, which is comparatively heat-resistant and thus, after use of the article, still has sufficient mechanical strength to ensure a trouble-free handling of the article and additionally has a flame-retarding effect, so that an aerosol-generating article manufactured therefrom cannot be smoked like a smoking article. This is achieved by a high content of specific char-formers in the wrapper paper.

BACKGROUND AND PRIOR ART

In the prior art, aerosol-generating articles are known which comprise an aerosol-generating material as well as a paper which wraps the aerosol-generating material, and thereby forms a typically cylindrical rod. In this regard, the aerosol-generating material is a material that releases an aerosol upon heating, wherein the aerosol-generating material is only heated but not burnt. In many cases, the aerosol-generating article also comprises a filter which can filter components of the aerosol and which is wrapped by a filter wrapper paper as well as by an additional wrapper paper that connects the filter and the wrapped rod with aerosol-generating material together.

During the intended use of an aerosol-generating article, it is usual for the aerosol-generating material to be heated but not burnt. This heating can, for example, be carried out by an external device, into which the aerosol-generating article is inserted, or by a heat source attached to one end of the aerosol-generating article, which, in order to use the article, is put into operation by lighting. During heating of the aerosol-generating material also the wrapper paper is heated and thermally degraded. This could cause the wrapper paper to lose so much strength that it tears during removal of the aerosol-generating article from the heating device. This requires an additional cleaning effort by the consumer and is thus not desirable. In addition, with aerosol-generating articles with an integrated heat source, the wrapper paper could lose its strength during heating so that the heat source drops off and a risk of fire arises.

Furthermore, it is desirable to prevent the consumer from inadvertently using aerosol-generating articles in the same way as a cigarette and trying to light an end of the aerosol-generating article so that a combustion or a smoldering process of the aerosol-generating material is started. Thus, the wrapper paper of the aerosol-generating article is required to have flame-retardant properties.

Attempts to make wrapper papers for such aerosol-generating articles heat-resistant or flame-retardant have only been partially successful.

In WO 2015/082648, for example, a wrapper paper is described that consists of comparatively few pulp fibers and is coated with a composition of calcium carbonate and a binder so that at least 50% of the wrapper paper is formed by calcium carbonate. The disadvantage with this wrapper paper is that because of the thick coating, it is comparatively brittle and a lot of dust is generated during manufacture of an aerosol-generating article from the wrapper paper. Furthermore, due to the low fiber content, the tensile strength is not particularly high.

In WO 2011/117750, a wrapper paper is described which consists of a laminate of an aluminum foil and a paper. The aluminum foil is facing towards the aerosol-generating material and partially protects the paper from the effects of heat. The disadvantages with this wrapper paper are the complex manufacturing process and the low biological degradability, because experience has shown that after use, many aerosol-generating articles are simply disposed of in the environment.

Thus, there is an interest in having a wrapper paper available which still has sufficient tensile strength after heating, has a flame-retardant effect and despite this is biodegradable. Furthermore, the design of wrapper papers for aerosol-generating articles has to take legal regulations, toxicology and the influence of the wrapper paper on the taste of the aerosol-generating article inter alia into consideration.

BRIEF DESCRIPTION OF THE INVENTION

An objective of the invention is to provide a wrapper paper for an aerosol-generating article that is essentially heat-resistant or flame-retardant and has advantageous properties having regard to strength, processability, biological degradability and influence on taste.

Aerosol-generating articles in the context of this invention are rod-shaped articles which comprise an aerosol-generating material and a wrapper paper that wraps the aerosol-generating material, wherein during the intended use, the aerosol-generating material is only heated but not burnt. Heating without combustion will in any case occur for typical aerosol-generating materials, for example, tobacco, if the aerosol-generating material is heated to a temperature of at most 400° C.

This objective is achieved by means of a wrapper paper for an aerosol-generating article, an aerosol-generating article comprising this wrapper paper, the use of such a wrapper paper for aerosol-generating articles and a process for manufacturing a wrapper paper according to the claimed invention. Further advantageous embodiments are provided in the dependent claims.

The inventors have found that this objective can be achieved by means of a wrapper paper that is suitable for use in aerosol-generating articles and which comprises pulp fibers and a char-m former, wherein the pulp fibers make up at least 70% and at most 95% of the mass of the wrapper paper and the char-former is contained in a concentration of at least 5% and at most 20% with respect to the mass of the wrapper paper and is contained in such a concentration in the wrapper paper that the quotient $r=R_T/R_o$ of the tensile strength $R_o$ measured in accordance with ISO 1924-2:2008 under the conditions of ISO 187:1990 and of the tensile strength $R_T$ measured in accordance with ISO 1924-2:2008 under the conditions of ISO 187:1990 after the wrapper paper has been exposed to a temperature of 230° C. for one minute, is at least 0.20 and at most 0.90.

According to the findings of the inventors, the high pulp fiber content is necessary in order to obtain a high initial strength of the wrapper paper. It is known that many char-formers, which could potentially be used in papers, damage the pulp fibers in paper and thus quickly lead to a substantial loss of strength upon heating. However, they protect the pulp fibers lying further within the paper structure from thermal degradation. Because paper is generally easy to burn, it is generally assumed that char-formers need to be used in a very high concentration in paper for an effective flame-retardant effect. At this concentration, however, the general assumption and also the inventors' experiments indicate that the pulp fibers are so heavily damaged and the strength is reduced so strongly that their use cannot reasonably be considered.

In contrast to that, the inventors have discovered that for a few char-formers there is in fact a suitable narrow range of concentrations in which a good flame-retardant effect is present and the reduction of the strength of the paper is not too great.

Only the combination of a high pulp fiber content and the suitably chosen concentration of the char-former enables a wrapper paper to be manufactured which, due to its high initial strength and despite the loss of strength due to the char-former, also has such a high tensile strength after heating that an aerosol-generating article manufactured therefrom can be removed from the heating device without any problems or that there is no danger that a heat source integrated into the aerosol-generating article could drop off. The flame-retardant effect is sufficient, moreover, so that the aerosol-generating article cannot be smoked like a cigarette.

Additionally, the components of the wrapper paper allow for an excellent biological degradability and a very good processability during manufacture of the aerosol-generating article.

For its strength, the wrapper paper needs pulp fibers, wherein the pulp fibers make up at least 70% and at most 95% of the mass of the wrapper paper. In order to obtain an even better ratio between pulp fibers and char-former, the proportion of pulp fibers can preferably be at least 75% and at most 90% and particularly preferably at least 80% and at most 90%, each with respect to the mass of the wrapper paper.

The pulp fibers are preferably sourced from one or more plants which are selected from the group consisting of coniferous wood, deciduous wood, spruce, pine, fir, beech, birch, eucalyptus, flax, hemp, jute, ramie, aback sisal, kenaf and cotton. The pulp fibers may also be entirely or partially formed by fibers from regenerated cellulose such as Tencel™ fibers, Lyocell™ fibers, viscose fibers or Modal™ fibers.

Preferably, the pulp fibers are formed by pulp fibers from coniferous trees in a proportion of at least 40% and at most 100% with respect to the mass of the pulp fibers, because these pulp fibers provide the wrapper paper with high strength.

The wrapper paper contains a char-former, wherein the char-former makes up at least 5% and at most 20% of the mass of the wrapper paper. According to the findings of the inventors, the char-former protects pulp fibers lying inside the paper structure from too much oxidation, but by itself also damages the pulp fibers, so that the concentration of the char-former has to lie in a narrow range and depends on the type of char-former. At increasing concentrations of the char-former, the flame-retardant effect gets stronger, but the strength of the wrapper paper after heating decreases because of the increasing damage to the pulp fibers. Preferably, the proportion of the char-formers in the wrapper paper is thus at least 9% and at most 16% of the mass of the wrapper paper.

Preferably, the char-former is an ammonium phosphate and particularly preferably a monoammonium phosphate, a diammonium phosphate, a triammonium phosphate or an ammonium polyphosphate or a mixture thereof. Less preferably, the char-former is a guanyl urea phosphate, guanidine phosphate, phosphoric acid, a phosphonate, melamine phosphate, dicyandiamide, boric acid or borax. These less preferred compounds are more difficult to process or are toxicologically not entirely unproblematic. Sodium polyphosphate is also a char-former, but is not in accordance with the invention.

The selection of the concentration of the char-former is not free within the interval provided, but depends on the type of char-former and has to be chosen such that the reduction of the strength of the wrapper paper after heating is not too high.

For this purpose, the tensile strength of the wrapper paper in the machine direction is determined as a characteristic feature of the strength and is determined firstly under the conditions of ISO 187:1990 and then after heating the wrapper paper. More precisely, the loss in strength can be determined in accordance with the following method.

Firstly, a paper sample of suitable geometry, typically a 15 mm wide strip, is conditioned in accordance with ISO 187:1990 and is tested in a tensile test in accordance with ISO 1924-2:2008. The tensile strength depends on the direction in which the paper sample has been taken. Here, tensile strength should always be understood to be the tensile strength in the running direction of the wrapper paper during paper manufacture, the so-called machine direction.

The initial tensile strength, designated by $R_o$, is determined according to the invention by conditioning the paper sample in accordance with ISO 187:1990 without a preceding thermal load and testing in accordance with ISO 1924-2:2008. The tensile strength after thermal load, $R_T$, is determined by exposing the sample for one minute to a temperature of 230° C. in air, wherein the air can reach essentially all sides of the paper sample and a low air flow is present. Then the paper sample is conditioned in accordance with ISO 187:1990 and also the tensile strength is determined in accordance with ISO 1924-2:2008. The quotient $r=R_T/R_o$ describes which proportion of the tensile strength remains after thermal load of the wrapper paper and thus characterizes the thermal resistance of the wrapper paper. High values for the quotient r describe a high thermal resistance. In accordance with the invention, the concentration of the char-former in the wrapper paper should be selected such that the quotient r of the tensile strength $R_T$ after thermal load (230° C. for one minute) and the initial tensile strength $R_o$ is at least 0.20 and at most 0.90 and particularly preferably at least 0.25 and at most 0.80. This means that the tensile strength is not reduced by more than 80%.

The quotient can be influenced by the amount of pulp fibers and the type and concentration of the char-former, wherein more pulp fibers lead to a higher initial tensile strength $R_o$ and an increasing concentration of the char-former generally leads to a decreasing tensile strength after thermal load $R_T$. The negative effect of the char-former on the tensile strength $R_T$ has to be balanced against the better flame-retardant effect with increasing concentration based on on the type of application of the aerosol-generating article. It was found that in the interval according to the invention and the preferred interval for the concentration of the char-former, a very good compromise can be found for aerosol-generating articles.

Preferably, the tensile strength $R_T$ should not fall below a certain value after thermal loading so that trouble-free handling of the aerosol-generating article during and after use is possible. Preferably, the tensile strength of the wrapper paper $R_T$ in the machine direction after thermal loading is at least 8 N/15 mm and at most 50 N/15 mm and particularly preferably at least 10 N/15 mm and at most 40 N/15 mm.

According to the findings of the inventors, it is important to know how the char-former is distributed over the thickness of the wrapper paper. Generally, a good flame-retardant effect can in fact be obtained if the char-former is distributed essentially homogeneously in the wrapper paper. In a preferred embodiment, however, the wrapper paper is designed such that the side of the wrapper paper facing the aerosol-generating material contains a higher proportion of char-former than the other side of the wrapper paper. The side facing the aerosol-generating material is typically exposed to a higher thermal load. A higher content of char-former on this side of the wrapper paper can thus contribute particularly well to the flame-retardant effect. In this manner, the proportion of char-former in the wrapper paper can be reduced without losses of the flame-retardant effect and thus the proportion of pulp fibers in the wrapper paper can be increased for the same basis weight, whereupon overall, the strength of the wrapper paper is increased. Alternatively at this preferred distribution of the char-former in the wrapper paper, the basis weight can also be reduced without losses regarding the flame-retardant effect, which reduces the material requirements.

The distribution of the char-former in the wrapper paper can be influenced by the manufacturing process, as explained further below.

Preferably, the char-former is distributed essentially uniformly over at least 70% of the surface area of the wrapper paper, particularly preferably over at least 95% of the surface area, wherein variations in the proportion of the char-former within these surface areas are only caused by the manufacturing, but are not intended.

A disadvantage of the char-former may be that it discolors the wrapper paper to make it dark under thermal load. This disadvantage can be overcome by combining the wrapper paper according to the invention with a further paper layer, for example, by gluing, so that the wrapper paper according to the invention faces the aerosol-generating material and the further paper layer is located on the side facing away from the aerosol-generating material. Under thermal load, this further paper layer covers the wrapper paper so that the color visible from the outside is not or is only insignificantly changed.

Preferably, the wrapper paper is thus combined with a paper layer. Particularly preferably, this paper layer comprises pulp fibers and calcium carbonate particles, wherein the calcium carbonate particles make up at least 15% and at most 40% of the mass of the paper layer. The calcium carbonate particles provide the paper layer with a white color and a high opacity, so that the discoloration of the wrapper paper according to the invention lying under it is not or is only slightly visible. It should be noted that the wrapper paper with the further paper layer as a whole could also be described as a "two-layer wrapper paper", but this designation is avoided here. Instead, in the language of the present disclosure, such a two-layered structure is termed a "wrapper paper with a further paper layer", because only the part of the two-layered structure designated as the "wrapper paper" needs to fulfill the above requirements regarding pulp fibers, char-formers and the quotient of the tensile strengths.

In addition to the pulp fibers and the char-former, the wrapper paper according to the invention can contain further components. This includes, for example, filler materials, sizing agents, wet strength agents, additives, processing aids, humectants and flavors. The skilled person can select these components according to experience. In particular, wet strength agents can be helpful for applications to aerosol-generating articles, because the aerosol formed during use of the aerosol-generating article has a high moisture content. The wrapper paper can absorb the water from the aerosol, whereupon its strength is reduced. This can be prevented by the use of wet strength agents.

The filler materials in the wrapper paper can contribute to reduced discoloration of the wrapper paper. The filler materials, however, also reduce the tensile strength of the wrapper paper, so their proportion should not be too high. Preferably, the proportion of filler materials in the wrapper paper is thus at least 0% and at most 20%, particularly preferably at least 0% and at most 10% and in particular at least 0% and at most 5%, each with respect to the mass of the wrapper paper.

The filler material is selected from the group consisting of calcium carbonate, magnesium carbonate, titanium dioxide, magnesium oxide, magnesium hydroxide, aluminum hydroxide, kaolin, talcum and mixtures thereof. Less preferably, the filler material is a carbonate.

In a preferred embodiment, the wrapper paper additionally contains starch or a starch derivative, or is coated with starch or a starch derivative. The proportion of the starch or the starch derivative in this preferred embodiment is at least 2% and at most 10% of the mass of the wrapper paper. This preferred embodiment offers a resistance against the penetration of oils as an additional advantage. The aerosol-generating material can contain oils, for example, flavors, which penetrate the wrapper paper during storage or use of the aerosol-generating article and cause stains. The resistance against the penetration of oils can be determined in accordance with TAPPI T559 cm-12 and is given as the KIT level. In this preferred embodiment, the KIT level is at least 4 and at most 8.

The basis weight of the wrapper paper can vary, wherein a higher basis weight generally also means a higher tensile strength. With a higher basis weight, however, the wrapper paper becomes stiffer and more difficult to process and the material requirements increase. Preferably, the basis weight of the wrapper paper according to the invention is thus at least 15 $g/m^2$ and at most 80 $g/m^2$, particularly preferably at least 20 $g/m^2$ and at most 60 $g/m^2$. The basis weight of the wrapper paper can be determined in accordance with ISO 536:2019.

The thickness of the wrapper paper primarily influences the bending stiffness and heat transfer within the wrapper paper. A high bending stiffness is advantageous, because then the aerosol-generating article manufactured from the wrapper paper deforms less, but on the other hand, a high bending stiffness can cause problems because of the restoring forces when the aerosol-generating material is to be wrapped with the wrapper paper. A high thickness slows the heat transfer through the wrapper paper and is also advantageous for this reason. Preferably, the thickness of the wrapper paper according to the invention is at least 25 μm and at most 100 μm and particularly preferably at least 40 μm and at most 80 μm. The thickness can be determined on a single layer in accordance with ISO 534:2011.

The initial tensile strength $R_o$, of the wrapper paper, measured in the machine direction, is preferably at least 10 N/15 mm and at most 100 N/15 mm, particularly preferably at least 20 N/15 mm and at most 80 N/15 mm. A high tensile strength can be obtained by a high proportion of pulp fibers. But this also means higher material requirements, for which reason it is not sensible to wish to obtain a particularly high tensile strength. The preferred intervals allow for a particularly advantageous combination of trouble-free processability and material requirements. The tensile strength can be determined in accordance with ISO 1924-2:2008.

The aerosol-generating material often contains humectants so that during heating, the aerosol that is generated has a comparatively high moisture content. This moisture can reduce the strength of the wrapper paper, for which reason it is advantageous if the wrapper paper also has a suitable wet strength. The wet strength in the machine direction is thus preferably at least 1 N/15 mm and at most 10 N/15 mm and particularly preferably at least 2 N/15 mm and at most 8 N/15 mm. The wet strength can be determined in accordance with ISO 12625-5:2016.

The air permeability of the wrapper paper can be low. A low air permeability can often be obtained by refining the pulp fibers more intensely. This also contributes to an increase in strength, so that preferably, the air permeability is a least 0 $cm^3/(cm^2 \cdot min \cdot kPa)$ and at most 50 $cm^3/(cm^2 \cdot min \cdot kPa)$ and particularly preferably at least 0 $cm^3/(cm^2 \cdot mink \cdot Pa)$ and at most 20 $cm^3/(cm^2 \cdot min \cdot kPa)$. The air permeability can be measured in accordance with ISO 2965:2019.

If the wrapper paper according to the invention is visible on the aerosol-generating article from the outside, optical properties may be of importance. Generally, a high opacity and a high brightness are desired. Both properties can be substantially influenced by the type and amount of the filler material in the wrapper paper. Preferably, the opacity is at least 40% and at most 90%, particularly preferably at least 45% and at most 80%. Preferably, the brightness is at least 80% and at most 95%, particularly preferably at least 83% and at most 90%.

Aerosol-generating articles can be manufactured from the wrapper paper according to the invention in accordance with processes that are known in the prior art. An aerosol-generating article according to the invention thus comprises an aerosol-generating material and a wrapper paper according to one of the aforementioned embodiments, wherein the wrapper paper wraps the aerosol-generating material.

In a preferred embodiment of the aerosol-generating article, the proportion of said char-former is higher on one side of the wrapper paper than on the other side and the side with the higher proportion of char-former faces the aerosol-generating material.

The wrapper paper according to the invention can advantageously be used in aerosol-generating articles, for which reason the use of the wrapper paper according to the invention in aerosol-generating articles is also an objective of the invention.

The wrapper paper according to the invention can be manufactured according to the following process according to the invention, comprising the steps A to G.

A—suspending pulp fibers in an aqueous suspension,
B—refining the suspended pulp fibers in a refining unit,
C—applying the suspension to a running wire,
D—forming a fiber web by de-watering the suspension,
E—pressing the fiber web,
F—drying the fiber web,
G—rolling up the wrapper paper, wherein between the steps F and G, at least one composition containing char-former is applied to the fiber web and the fiber web is dried in order to form the wrapper paper, and wherein the wrapper paper from step G comprises pulp fibers and char-former and the pulp fibers make up at least 70% and at most 95% of the mass of the wrapper paper and the char-former makes up at least 5% and at most 20% of the mass of the wrapper paper, and wherein the char-former is contained in a concentration in the wrapper paper such that the quotient $r=R_T/R_o$ of the tensile strength $R_o$, measured in accordance with ISO 1924-2:2008 under the conditions of ISO 187:1990 and of the tensile strength $R_T$ measured in accordance with ISO 1924-2:2008 under the conditions of ISO 187:1990 after the wrapper paper has been exposed to a temperature of 230° C. for one minute is at least 0.20 and at most 0.90.

Preferably, the step of applying the composition containing the char-former to the fiber web is carried out by one or a combination of two or more of the following steps:

F.1 application of a composition containing char-former to the fiber web in a size press of a paper machine,
F.2 one-sided application of a composition containing char-former to the fiber web in a film press or a coating unit of a paper machine, and
F.3 one-sided application of a composition containing char-former to the fiber web by printing, in particular roto-gravure printing or spraying.

In this regard, step F.1 is carried out in the size press and the fiber web is therefore impregnated with a composition containing char-former. This variation offers the advantage that it can be carried out easily. It generally leads to a substantially homogeneous distribution of the char-former over the thickness of the wrapper paper, so that comparatively more char-former is needed in order to obtain the desired effect. However, it is in fact also possible to adjust the settings of the size press in this step, so that the char-former is distributed unevenly over the thickness of the fiber web and thus of the wrapper paper.

According to step F.2, the composition containing char-former is applied to one side of the fiber web in a film press or in a coating unit. This brings about an uneven distribution of the char-former over the thickness of the wrapper paper and the high flame-retardant effect can be obtained by a smaller proportion of char-former in the wrapper paper.

According to step F.3, the composition containing char-former is applied to one side of the fiber web by printing or spraying, wherein in particularly preferred embodiments, the composition is printed by a roto-gravure printing unit on one side of the fiber web. In this regard, the fiber web is preferably dried before step F.3, rolled up and unrolled again. In the rolled-up state, the fiber web can then be transported to a further device on which the application of the composition can be carried out by printing or spraying. While the steps F.1 and F.2 can as a rule be carried out on the same paper machine on which the wrapper paper is manufactured, the application according to step F.3 is typically carried out in a separate device.

In a highly particularly preferred embodiment, the steps F.1 and F.3 are combined, so that firstly, in a step F.1, the fiber web is impregnated with a composition containing char-former in a size press and in step F.3, a further composition containing char-former is printed on one side of the fiber web in a roto-gravure printing unit. In this highly particularly preferred embodiment, the char-former is both distributed in the wrapper paper and is present in a higher concentration on one side of the wrapper paper, whereupon the flame-retardant effect can be significantly further increased.

In a further highly particularly preferred embodiment, the steps F.1 and F.2 are combined, wherein the step F.1 is carried out in a size press and the step F.2 in a coating unit.

In this highly particularly preferred embodiment, the wrapper paper can be manufactured particularly efficiently because, for example, all of the application devices can be integrated into one paper machine.

Independently of which of the step or steps F.1, F.2 or F.2 is or are employed, the composition containing char-former is preferably applied to at least 70% of the surface area of the wrapper paper, particularly preferably to at least 95% of the surface area of the wrapper paper.

The composition that is used in steps F.1, F.2 or F.3 contains the char-former and a solvent, wherein the solvent is preferably water. The amount of the char-former in the composition can vary and depends on the type of the application process, the applied amount and the desired amount of char-former in the wrapper paper. The skilled person will be capable of determining a suitable composition with these considerations in mind, and of designing the application process accordingly.

In the highly particularly preferred embodiment, one of the steps F.1 and F.2 is carried out, the fiber web is then dried, rolled up and unrolled again, and then step F.3 is carried out, wherein the fiber web in the dried, rolled-up state before step F.3 contains the char-former preferably in an amount of at least 5% and at most 10% of the mass of the fiber web in this dried and rolled-up state.

If the steps F.1, F.2 and/or F.3 are combined in any form, the compositions containing char-former that are applied in the steps F.1, F.2 and/or F.3 can be different.

In the wrapper paper after step G, the pulp fibers make up at least 70% and at most 95% of the mass of the wrapper paper. In order to obtain an even better ratio between pulp fibers and char-former the proportion of pulp fibers can preferably be at least 75% and at most 90% and particularly preferably at least 80% and at most 90%, each with respect to the mass of the wrapper paper after step G.

The pulp fibers in step A are preferably sourced from one or more plants that are selected from the group consisting of coniferous wood, deciduous wood, spruce, pine, fir, beech, birch, eucalyptus, flax, hemp, jute, ramie, aback sisal, kenaf and cotton. The pulp fibers may also be entirely or partially formed by fibers produced from regenerated cellulose such as Tencel™ fibers, Lyocell™ fibers, viscose fibers or Modal™ fibers.

Preferably, the pulp fibers in step A are formed by pulp fibers from coniferous trees in a proportion of at least 40% and at most 100% with respect to the mass of the pulp fibers, because these pulp fibers provide the wrapper paper in step G with a high initial strength.

The wrapper paper after step G contains char-former, wherein the char-former makes up at least 5% and at most 20% of the mass of the wrapper paper. Preferably, the proportion of char-former in the wrapper paper after step G is at least 9% and at most 16% of the mass of the wrapper paper.

Preferably, the char-former is an ammonium phosphate and particularly preferably a monoammonium phosphate, a diammonium phosphate, a triammonium phosphate or an ammonium polyphosphate or a mixture thereof. Less preferably, the char-former is a guanyl urea phosphate, guanidine phosphate, phosphoric acid, a phosphonate, melamine phosphate, dicyandiamide, boric acid or borax. These less preferred compounds are more difficult to process or are toxicologically not entirely unproblematic. Sodium polyphosphate is also a char-former, but is not in accordance with the invention.

In a preferred embodiment, after step G, the wrapper paper is a wrapper paper according to one of the aforementioned embodiments.

DESCRIPTION OF THE PREFERRED EMBODIMENTS

Some preferred embodiments of wrapper papers according to the invention will now be described.

A wrapper paper P1 according to the invention was manufactured on a fourdrinier paper machine. To this end, pulp fibers were suspended in water (step A) and refined in a refining unit (step B). Then the suspension was applied to a running wire (step C) and de-watered there in order to form a fiber web (step D). The fiber web was pressed (step E) in order to de-water it further and dried by contact with heated drying cylinders (step F). In a size press of the paper machine, the fiber web was impregnated over the entire surface on both sides with a composition comprising water and monoammonium phosphate (step F.1) and the fiber web was then dried by contact with heated drying cylinders. Finally, the fiber web was rolled up (step G) and wrapper paper P1 according to the invention was obtained.

The amount of pulp fibers was selected so that about 87% of the mass contained in the wrapper paper P1 was pulp fibers. The composition in step F.1 comprised water and monoammonium phosphate and was chosen together with the settings of the size press such that the amount of monoammonium phosphate in the wrapper paper after step G was about 7%. It can be assumed that the distribution of the monoammonium phosphate in the wrapper paper P1 over the thickness was essentially homogeneous.

A wrapper paper P2 according to the invention was manufactured from the wrapper paper according to the invention P1, by unrolling the reel of wrapper paper P1 and printing a composition comprising water and monoammonium phosphate over the full surface on one side of the wrapper paper in a roto-gravure printing unit (step F.3). Then the wrapper paper was dried by hot-air drying and rolled up again (step G). The composition in step F.3 was chosen together with the settings of the roto-gravure printing unit and in particular with the geometry of the printing cylinder was chosen such that in the finished wrapper paper P2, a total of 12.5% of the mass of the wrapper paper was formed by monoammonium phosphate. An inhomogeneous distribution of the monoammonium phosphate in the wrapper paper was obtained in this manner, so that the content of monoammonium phosphate was higher on the printed side than on the other side.

In wrapper paper P2, 82% of the mass was formed by pulp fibers.

A wrapper paper Z1 not according to the invention, comprising 70% pulp fibers and 29% precipitated calcium carbonate, but without char-former was used as comparative example.

In addition, a wrapper paper Z2 not according to the invention comprising 90% pulp fibers and 10% sodium polyphosphate, $(NaPO_3)_n$ as char-former was used as comparative example. To obtain a further wrapper paper P3, the wrapper paper Z1 not according to the invention was glued to the wrapper paper according to the invention P2 to form a two-layered structure in a manner such that the side of the wrapper paper P2 with the higher content of monoammonium phosphate was facing away from the wrapper paper Z1.

The data for the wrapper papers P1 and P2 according to the invention, the two-layered structure P3 and the comparative examples Z1 and Z2 not according to the invention were determined in accordance with the routine standards.

For the determination of the tensile strength after thermal load $R_T$, the wrapper papers P1, P2, P3 and Z1, Z2 were stored in a drying oven heated to 230° C. for one minute. Then they were conditioned in accordance with ISO 187:1990 and the tensile strength was measured in accordance with ISO 1924-2:2008.

From the initial tensile strength $R_o$ and the tensile strength $R_T$ after thermal load, the quotient $r=R_T/R_o$ was determined in order to characterize the thermal resistance.

All data for the wrapper papers P1, P2, P3 and Z1, Z2 can be found in Table 1.

TABLE 1

| | | P1 | P2 | P3 | Z1 | Z2 |
|---|---|---|---|---|---|---|
| Basis Weight | $g/m^2$ | 28.8 | 31.9 | 72.2 | 29 | 30.3 |
| Thickness | μm | 46.4 | 46.4 | 79.2 | 45.3 | 47.3 |
| Tensile Strength $R_o$ | N/15 mm | 30.4 | 36.0 | 65.7 | 15.2 | 32.7 |
| Tensile Strength $R_T$ | N/15 mm | 16.7 | 12.1 | 27.2 | 14.3 | 6.3 |
| $r = R_T/R_o$ | | 0.55 | 0.34 | 0.41 | 0.94 | 0.19 |
| Wet Strength | N/15 mm | 3.0 | 3.0 | 10.1 | 2.5 | 3.1 |
| Air Permeability | $cm^3/(cm^2 \cdot min \cdot kPa)$ | <20 | <20 | <20 | 60 | <20 |
| Opacity | % | 44.8 | 41.8 | 41.2 | | |
| Brightness | % | 87.4 | 88.6 | 88.6 | | |

Table 1 shows that for the wrapper papers P1 and P2 according to the invention, as well as for the two-layered structure P3 containing the wrapper paper P2 according to the invention, the thermal load reduces the tensile strength by 34% to 55%. For the comparative example Z1 not according to the invention, which does not contain char-former, the tensile strength is hardly reduced by the thermal load and is still about 94% of the initial tensile strength. For the comparative example Z2 not according to the invention, which contains sodium polyphosphate as char-former, the tensile strength after thermal load is only about 19% of the initial tensile strength and also the absolute value of 6.3 N/15 mm is too low to be able to remove an aerosol-generating article manufactured therefrom from the heating device after use without problems.

The wrapper papers P1 and P2 according to the invention and the two-layered structure P3 all exhibit an acceptable reduction of the tensile strength. But it is noticeable, in comparison to the wrapper papers P1 and P2 according to the invention, that the higher content of monoammonium phosphate in wrapper paper P2 damages the fibers more and reduces the tensile strength after thermal load more severely.

In addition to not too strong a reduction of the tensile strength, the flame-retardant effect is also of importance. To test the flame-retardant effect, aerosol-generating articles, which are intended for use in a heating device, were manufactured from the wrapper papers P1/P2 according to the invention, the two-layered structure P3 and the comparative examples Z1 and Z2 not according to the invention. The manufacture of the aerosol-generating articles was without any problems for all wrapper papers. When attempting to light the aerosol-generating article like a cigarette with a lighter, it became immediately clear that the comparative example Z1 not according to the invention had no flame-retardant effect. The aerosol-generating article manufactured therefrom could be lit without problems. Despite the longer action of the flame of the lighter, the aerosol-generating articles with the wrapper papers P1/P2 according to the invention, the two-layered structure P3 and the comparative example Z2 not according to the invention could not be lit such that combustion or a stable smoldering process could be started. It was also not possible to smoke these aerosol-generating articles according to a standardized process. With regards to the flame-retardant effect, the wrapper paper according to the invention P2 proved slightly better than P1, which indicates that an uneven distribution of the char-former over the thickness of the wrapper paper can contribute to an enhancement of the flame-retardant effect.

The two-layered structure P3 was a laminate of the wrapper paper P2 according to the invention and the comparative example Z1 not according to the invention and after use of the aerosol-generating article manufactured therefrom showed significantly less discoloration than the aerosol-generating articles with P1 and P2. The wrapper paper Z1 thus fulfilled its function of covering the discoloration of wrapper paper P2.

An influence on the taste of the aerosol-generating articles could not be found.

The wrapper papers according to the invention are thus very well suited for use in aerosol-generating articles and, along with good biological degradability, have a strength after heating and a flame-retardant effect in a better combination than comparable wrapper papers in the prior art.

The invention claimed is:

1. Aerosol-generating article which comprises a wrapper paper and an aerosol-generating material, wherein the aerosol-generating article is configured to be heated, but not burnt, wherein the wrapper paper wraps the aerosol-generating material, wherein the wrapper paper comprises pulp fibers and a char-former, wherein the pulp fibers make up at least 70% and at most 95% of the mass of the wrapper paper, wherein the char-former is at least substantially uniformly distributed over at least 70% of the surface area of the wrapper paper and the char-former is contained in a concentration of at least 5% and at most 20% with respect to the mass of the wrapper paper and is present in a concentration in the wrapper paper such that the quotient $r=R_T/R_o$ of the tensile strength $R_o$, measured in accordance with ISO 1924-2:2008 under the conditions of ISO 187:1990, and of the tensile strength $R_T$, measured in accordance with ISO 1924-2:2008 under the conditions of ISO 187:1990 after the wrapper paper has been exposed to a temperature of 230° C. for one minute, is at least 0.20 and at most 0.90, and wherein the proportion of said char-former is higher on one side of the wrapper paper than on the other side and the side with the higher proportion of char-former faces the aerosol-generating material.

2. Aerosol-generating article according to claim 1, in which the proportion of pulp fibers in said wrapping paper is at least 75% and at most 90%, each with respect to the mass of the wrapper paper.

3. Aerosol-generating article according to claim 1, in which the pulp fibers are sourced from coniferous trees to a proportion of at least 40% and at most 100% with respect to the mass of the pulp fibers.

4. Aerosol-generating article according to claim 1, in which the proportion of char-formers in the wrapper paper makes up at least 9% and at most 16% of the mass of the wrapper paper.

5. Aerosol-generating article according to claim 1, wherein the char-former is a monoammonium phosphate, a diammonium phosphate, a triammonium phosphate, an ammonium polyphosphate or a mixture thereof, or wherein the char-former is at least partially formed by a guanyl urea phosphate, guanidine phosphate, phosphoric acid, a phosphonate, melamine phosphate, dicyandiamide, boric acid or borax.

6. Aerosol-generating article according to claim 1, wherein the tensile strength $R_T$ of the wrapper paper, after the wrapper paper has been exposed to a temperature of 230° C. for one minute is at least 8 N/15 mm and at most 50 N/15 mm.

7. Aerosol-generating article according to claim 1, in which the char-former is at least substantially uniformly distributed over at least 90% of the surface area of the wrapper paper.

8. Aerosol-generating article according to claim 1, wherein the wrapper paper is combined with a further paper layer, so that the wrapper paper according to the invention faces the aerosol-generating material during the intended use and the further paper layer is disposed on the side facing away from the aerosol-generating material.

9. Aerosol-generating article according to claim 8, wherein the further paper layer comprises pulp fibers and calcium carbonate particles, wherein the calcium carbonate particles make up at least 15% and at most 40% of the mass of the further paper layer.

10. Aerosol-generating article according to claim 1, wherein the wrapper paper further comprises at least one further component which is selected from the group consisting of filler materials, sizing agents, wet strength agents, additives, processing aids, humectants and flavors.

11. Aerosol-generating article according to claim 10, in which the proportion of filler materials is at least 0% and at most 20% each with respect to the mass of the wrapper paper.

12. Aerosol-generating article according to claim 10, wherein the filler material is selected from the group consisting of calcium carbonate, magnesium carbonate, titanium dioxide, magnesium dioxide, magnesium hydroxide, aluminum hydroxide, kaolin, talcum and mixtures thereof.

13. Aerosol-generating article according to claim 1, wherein the wrapper paper contains starch or a starch derivative or is coated with starch or a starch derivative, wherein the proportion of the starch or the starch derivative is at least 2% and at most 10% of the mass of the wrapper paper.

14. Aerosol-generating article according to claim 1, wherein said wrapper paper has a KIT level, determined in accordance with TAPPI T559 cm-12, which is at least 4 and at most 8.

15. Aerosol-generating article according to claim 1, wherein said wrapper paper has a basis weight of at least 15 $g/m^2$ and at most 80 $g/m^2$.

16. Aerosol-generating article according to claim 1, wherein said wrapper paper has a thickness of at least 25 μm and at most 100 μm.

17. Aerosol-generating article according to claim 1, wherein said wrapper paper has a tensile strength $R_0$ before a thermal load measured in the machine direction of at least 10 N/15 mm and at most 100 N/15 mm.

18. Aerosol-generating article according to claim 1, wherein the wet strength of said wrapper paper in accordance with ISO 12625-5:2016 in the machine direction is at least 1 N/15 mm and at most 10 N/15 mm.

19. Aerosol-generating article according to claim 1, wherein said wrapper paper has an air permeability of at least 0 $cm^3/(cm^2 \cdot min \cdot kPa)$ and at most 20 $cm^3/(cm^2 \cdot min \cdot kPa)$.

20. Aerosol-generating article according to claim 1, wherein said wrapper paper has an opacity of at least 40% and at most 80% and/or a brightness of at least 80% and at most 95%.

21. Aerosol-generating article according to claim 1, wherein the tensile strength $R_T$ of the wrapper paper, after the wrapper paper has been exposed to a temperature of 230° C. for one minute is at least 10 N/15 mm and at most 40 N/15 mm.

22. Aerosol-generating article according to claim 1, which is configured for use in a heating device and cannot be smoked like a cigarette.

* * * * *